United States Patent [19]

Anderson

[11] Patent Number: 4,805,378

[45] Date of Patent: Feb. 21, 1989

[54] ASEPTIC FILLING STATION

[75] Inventor: Ian M. Anderson, Sandringham, Australia

[73] Assignee: Wrightcel Limited, Auburn, Australia

[21] Appl. No.: 844,546

[22] Filed: Mar. 27, 1986

Related U.S. Application Data

[63] Continuation-in-part of Ser. No. 408,835, Aug. 17, 1982, abandoned.

[30] Foreign Application Priority Data

Aug. 18, 1981 [AU] Australia ..... PF0305

[51] Int. Cl.[4] ..... B65B 55/08; B65B 55/10; B65B 43/26; B65B 7/02

[52] U.S. Cl. ..... 53/426; 53/452; 53/468; 53/479; 53/558; 53/570; 53/373; 53/381 R; 53/381 A

[58] Field of Search ..... 53/425, 426, 452, 468, 53/469, 473, 479, 558, 570, 268, 275, 373, 381 R, 381 B, 109, 267, 512

[56] References Cited

U.S. PATENT DOCUMENTS

| | | | |
|---|---|---|---|
| 2,761,603 | 9/1956 | Fairchild | 53/510 |
| 2,930,170 | 3/1970 | Holsman et al. | 53/268 |
| 4,077,182 | 3/1978 | Papaluca | 53/109 |
| 4,257,535 | 3/1981 | Mellett | 53/479 |
| 4,360,996 | 11/1982 | Rutter | 53/469 |
| 4,519,184 | 5/1985 | Brunswick | 53/512 |
| 4,524,563 | 6/1985 | Sassi | 53/268 |

FOREIGN PATENT DOCUMENTS

| | | |
|---|---|---|
| 0026055 | 4/1981 | European Pat. Off. . |
| 3032404 | 3/1981 | Fed. Rep. of Germany . |
| 1129600 | 10/1968 | United Kingdom . |
| 1194332 | 6/1970 | United Kingdom . |

*Primary Examiner*—Horace M. Culver

[57] ABSTRACT

A method and system for aseptic filling of containers. The flexible containers (1) are presterilized and a rupturable membrane (41) covers the inlet to the container. The filling head (20) includes a recess (46) below the outlet valve (24) and this recess is closed by the rupturable membrane (41) when the container inlet is aligned with the filling head. After alignment sterilizing fluid is introduced into the recess to sterilize the outer surface of the membrane and the internal surfaces of the recess. Following sterilization the valve membrane (22) moves towards the rupturable membrane (41) allowing the piercing tool (25) to rupture said membrane. The outlet valve (24) of the filling head is opened and the liquid is allowed to flow into the container. Subsequent to completion of the filling cycle the inlet to the container is sealed and the sealed and filled container (1) is then removed from the filling head (20).

3 Claims, 3 Drawing Sheets

ASEPTIC FILLING STATION

Figure 1:
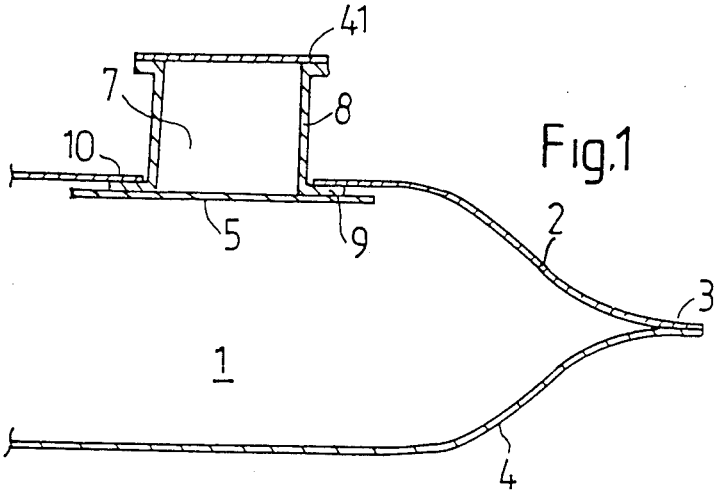

This application is a continuation-in-part of copending U.S. patent application Ser. No. 408,835, filed Aug. 17, 1982 and now abandoned.

This invention relates to a system of aseptic filling particularly for flexible containers made of synthetic plastic films.

Synthetic plastic flexible containers are useful for storing and dispensing wine, fruit juice and other liquid foodstuffs. Aseptic filling is a desirable mode of operation to ensure that the possibility of contamination or deterioration of the liquid product does not occur.

Generally aseptic filling is carried out by sterilizing the flexible containers internally and externally and maintaining the filling equipment in a sterile room. It is very difficult to ensure that the equipment and containers are maintained in aseptic conditions and the time and expense involved is high.

U.S. Pat. No. 2,761,603 (Fairchild) disclosed a method of aseptically filling rigid containers in which rigid containers are pre sterilized and sealed with a rupturable seal or membrane. The Fairchild filling machine incorporates a filling tube and a sterilizing head within the filling tube which pierces the rupturable seal and provides sterilizing fluid axially of the filling tube to sterilize the internal surfaces of the filling head and the rupturable seal prior to its rupture.

U.S. Pat. No. 3,926,229 (Scholle) discloses an aseptic filling head in which the valve member for the product outlet incorporates an axial sterilizing fluid conduct. In sterilizing fluid is flushed into the product outlet of the filling head and the containers inlet after the filling operation.

It is an object of this invention to provide a method and apparatus for aseptic filling of flexible containers with liquids.

To this end the present invention provides a method of aseptically filling containers charactered in the steps of: (a) sterilizing sealed containers in which the container inlet has a heat sealable flap on one side of said inlet and is covered on the other side of said inlet by a rupturable closure; (b) maintaining the internal surfaces of the filling dispenser in a sterile state; (c) bringing the closed inlet of the container into abutment with the outlet nozzle of the filling dispenser by means of a movable container support; (d) introducing sterilizing fluid into the space between said nozzle and said closed inlet in a direction lateral to product flow from said outlet nozzle into said container inlet withdrawing it laterally; (e) breaking said rupturable closure and filling said container; (f) closing said inlet by heat sealing said heat sealable flap to the interior side of said inlet; (g) introducing sterilizing fluid in to the space between said nozzle and said closed inlet in a direction lateral to product flow from said outlet nozzle in to said container inlet and withdrawing it laterally; (h) removing said container from said dispenser.

This invention also provides a system for aseptically filling and storing degradable liquid contents which comprises: (a) a flexible container having an inlet, said inlet being capable of being sealed by heat sealing a heat sealable flap onto one side of the inlet opening and incorporating over its other inlet opening a rupturable closure; (b) a fluid dispenser which incorporates (i) a fixed filling head having an internally disposed valve for regulating the flow of said liquid (ii) a sterilizable recess adjacent said valve (iii) a sterilizing fluid inlet and outlet in said recess disposed at an oblique angle to product flow through said recess; (c) radiation means for sterilizing the containers while closed with said rupturable closure; (d) container support means for bringing said container inlet into engagement with said filling head such that said recess is closed by said rupturable closure; (e) means for injecting said sterilizing fluid into said recess; (f) means to actuate said valve to allow liquid to pass through said recess, and fill said container, and (g) heat sealing means located external to and below the fixed filling head.

It can be seen that the need to sterilize the filling station environment and the exterior of the flexible container is eliminated by ensuring that the interior of the machine i.e. the fluid conduits and filling head and the interior of the container are sterile. Consequently only the exterior of the inlet seal and the external surface of the nozzle and the space between the nozzle and the inlet need be sterilized and this can be achieved as a preliminary step prior to filling.

The filling apparatus of this invention incorporates a sterilizable product conduit comprising two openings allowing for ingress or egress of product, a valve member for opening and closing said conduit a recess adjacent one of said openings, at least one sterilizing fluid inlet and at least one sterilizing fluid outlet onto said recess which are disposed at right angles to product flow through said recess, and means for rupturing a container seal located on said valve member.

The inlet and outlet within the nozzle recess may be the same in which case the conduit from said inlet/outlet port is connected to a source of sterilizing fluid and an extractor for withdrawing said fluid from the nozzle recess.

The filling head of this invention can be used as such or if connected to our extraction pump can be used to extract product from sealed containers under aseptic conditions by bringing a filled and sealed container into abutment with the head, sterilizing the recess and the container seal, rupturing the seal extracting product and closing the conduit.

An important aspect of this invention is the provision of sterilizing fluid inlets disposed laterally of product flow through the recess. Preferably the inlets are tangential to the circular recess wall to provide a swirling motion of the sterilizing fluid within the recess. This provides a much better cleaning action on the surface of the recess, the surface of the valve head and piercing tool and the surface of the rupturable membrane than can be provided by axial flow of the sterilizing fluid as taught in U.S. Pats. Nos. 2,761,603 (Fairchild) and 3,926,229 (Scholle). Similarly lateral extraction of sterilizing fluid is also more efficient than the reverse axial extraction as taught in the prior art by Scholle and Fairchild.

Preferably Gamma radiation is used to sterilize the sealed containers prior to filling and hydrogen peroxide or steam is used to sterilize the surfaces and space between the outlet nozzle and the container closure.

This invention is particularly applicable to the apparatus described in European patent application 82300 145 8 and the flexible container system described in U.S. Pat. No. 4,257,535. This disclosure of those two specifications are incorporated herein by reference.

When using the flexible container according to the above mentioned patent applications it is possible to improve the ease of ensuring sterility of the interior of the container by providing a rupturable membrane cover over the outer opening of the collar. This ensures that the interior of the collar remains sterile. However, it is not essential to provide such a cover if the membrane seal on the inner end of the collar is adequate.

Figure 2:
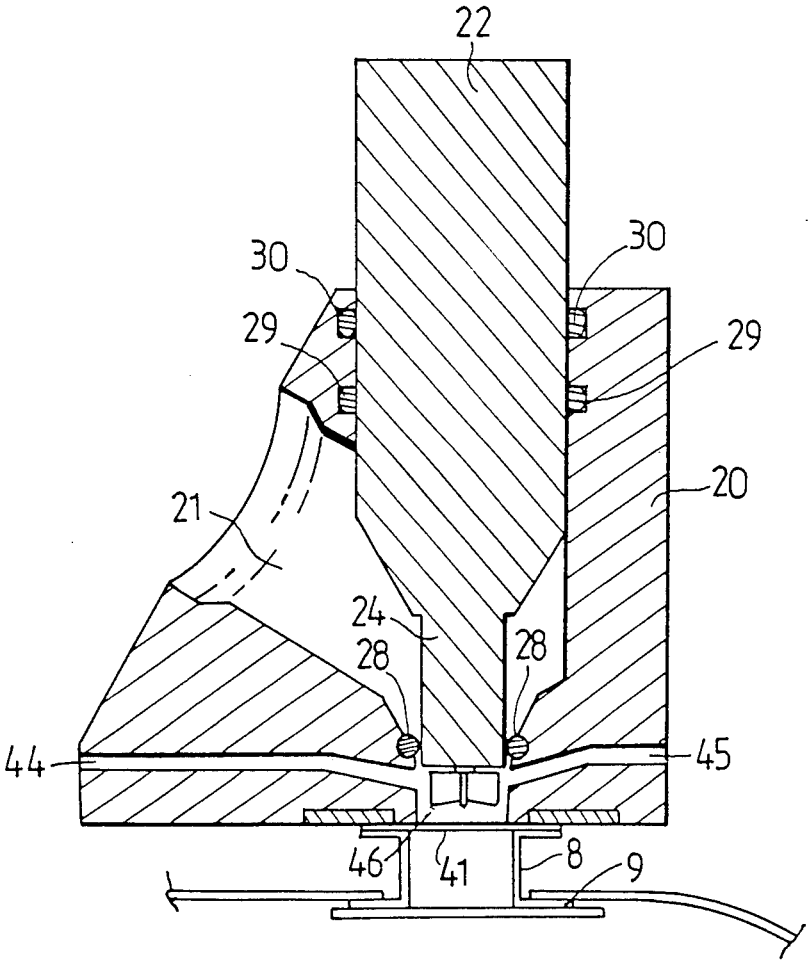
Figure 3:
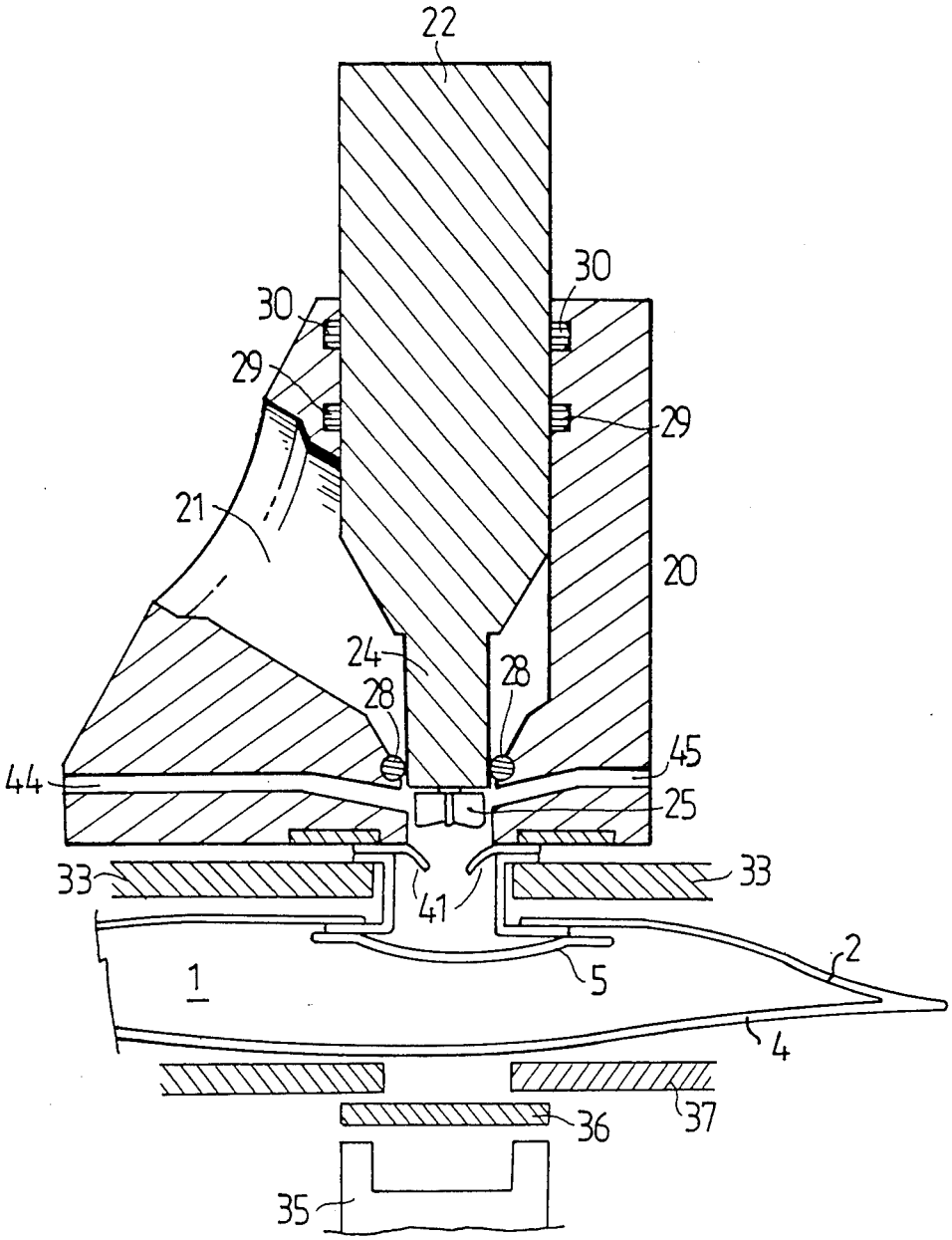
Figure 4:
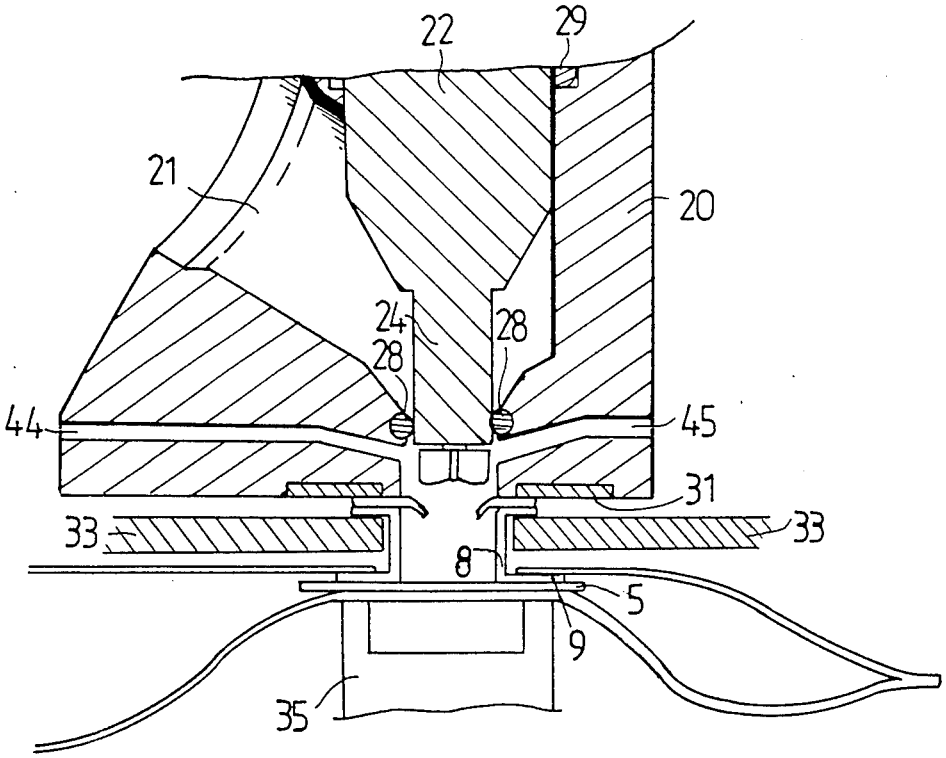

A preferred form of the invention will now be described, with reference to the drawings in which FIG. 1 is a schematic view of the container and collar, FIG. 2 is a sectional view of the filling nozzle, FIG. 3 is a cross-section through the head during the filling cycle, FIG. 4 is a cross-section showing the sealing operation while the container is still in position at the filling head.

Referring to FIG. 1, the bag—generally designated as 1—comprises a wall 2 heat sealed at the periphery 3 to the lower wall 4. The flap 5 extends across an opening 7 in the flexible container wall 2 into which fits a collar 8. The flange 9 of collar 8 is heat sealed to the periphery 10 of the opening and the flap 5 is partly sealed to the flange of collar 8. As mentioned above the collar 8 can easily be secured to wall 2 by suitable machinery. The surface of flap 5 which faces the internal surface of wall 4 is non heat sealable therewith but the surface of flap 5 which faces flange 9 is heat sealable with that flange. Preferably flap 5 is a laminate of a heat sealable and a non heat sealable material.

Across the outer opening of collar 8 is a rupturable membrane 41 which is either integrally formed during the moulding of collar 8 or is heat sealed thereto during the operation of attaching the collar 8 to the container wall 2. Apart from the membrane 41 the container and collar is as described in U.S. Pat. No. 4,257,535.

The filling apparatus is a modified version of that described in European patent application 82 300 1 458.

The filling head comprises a general body section 20 which includes a liquid inlet channel 21 closed by the valve member 22. This valve member 22 extends within the body section 20. The valve member 22 includes a valve head 24 which seals the outlet when in contact with the o-ring seal 28. A piercing tool 25 is attached to the lower portion of the valve head 24.

When the valve member 22 is in its closed position the liquid outlet channel 21 is sealed and the seals 28, 29 and 30 ensure that no liquid can escape once the valve member 22 is closed.

The sterilizing fluid inlet 44 and outlet 45 are connected to the nozzle recess 46 below the valve head 24. The number of inlets 44 and outlets 45 can be varied. By positioning several inlets tangentially about the periphery of recess 46 an efficient cleaning action can be achieved. One large exhaust port 45 is usually sufficient.

In FIG. 3 the complete flexible container is illustrated being held against the body section 20 by clamps 33. These clamps 33 grip the collar 8 and a trapdoor 36 supports the flexible container but provides a sufficient gap to enable liquid to flow through collar 8 past flap 5 and into the body of the flexible container 1. The support or trapdoor 36 is required to ensure that the pressure of the liquid during the filling does not rupture the container, or heat sealable flap.

The sequence of operations is that initially a flexible container 1, is taken by clamps 33 and lifted into alignment with the filling head such that collar 8 and membrane 41 abut tightly against the seal 31 on the body section 20. After contact is made between body section 20 and membrane 41 sterilizing fluid (either gas or liquid such as steam) is passed in to the recess 46 via inlet 44 and sterilizes the inner surfaces of the recess the valvehead 24, piercing member 25 and the surface of membrane 41. Subsequently the sterilizing fluid is withdrawn through outlet 45.

After completion of the sterilization step valve member 22 rises to open the product inlet 21 to enable filling of the flexible container to occur. The membrane 41 is ruptured during filling by the pressure of the liquid and is subsequently not needed since flap 5 will provide the permanent seal for the filled container. Alternatively the membrane 41 may be ruptured by piercing member 25 prior to the opening of liquid inlet 21 by lowering valve member 22.

Upon the completion of filling the valve member 22 closes inlet 21 at the o-ring seal 28.

At this point the trapdoor 36 is withdrawn and the heat sealing member 35 is brought into contact with the flexible container and results in the welding of flap 5 to the flange 9 of the collar 8 to seal the flexible container. After sealing sterilizing fluid is introduced through inlet 44 into recess 46 and collar 8 to remove all product from those areas and from the valvehead 24 and piercing member 25. If desired this flushing cycle could commence prior to the heat sealing step and end after heat sealing is completed.

Subsequent to sealing, the filled flexible container is withdrawn from the filling head and if desired the tap can be inserted into collar 8.

Conventional pneumatics can be used to operate the movements of the valve member 22 and the clamps 33, the trapdoor 36 and sealing member 35. The timing and control of these components is similarly capable of being carried out by conventional control circuitry.

The filling machine head as contained in body 20 may also be utilised for the extraction of product from the sealed containers. Where large bulk containers are used for dispensing smaller quantities, an extraction pump connected to the product inlet 21 and the seal 5 can be broken by the piercing member 25 and product removed by evacuation through recess 46 and conduct 21. A sterilizing step can take place prior to breaking the seal 5.

From the above it can be seen that this invention provides a simple means of ensuring aseptic filling of liquids.

The claims defining the invention are as follows:

1. A method of aseptically filling containers through a container inlet from a filling dispenser comprising the steps of: (a) sterilizing sealed containers in which the container inlet has a heat sealable flap on one side of said inlet and is covered on the other side of said inlet by a rupturable closure; (b) maintaining the internal surfaces of the filling dispenser in a sterile state; (c) bringing the closed inlet of the container into abutment with the outlet nozzle of the filling dispenser by means of a movable container support; (d) introducing sterilizing fluid into the space between said nozzle and said closed inlet in a direction laterally of product flow from said outlet nozzle into said container inlet and withdrawing it laterally; (e) breaking said rupturable closure and filling said container; (f) closing said inlet by heat sealing said heat sealable flap to the interior side of said inlet; (g) introducing sterilizing fluid in to the space between said nozzle and said closed inlet in a direction lateral to product flow from said outlet nozzle in to said container inlet and withdrawing it laterally; (h) removing said container from said dispenser.

2. A system for aseptically filling and storing degradable liquid contents which comprises: (a) a flexible container having an inlet, said inlet being capable of being sealed by heat sealing a heat sealable flap onto one side of the inlet opening and incorporating over its other inlet opening a rupturable closure; (b) a fluid dispenser which incorporates (i) a fixed filling head having an interally disposed valve for regulating the flow of said liquid (ii) a sterilizable recess adjacent said valve (iii) a sterilizing fluid inlet and outlet in said recess disposed at an oblique angle to product flow through said recess; (c) radiation means for sterilizing the containers while closed with said rupturable closure; (d) container support means for bringing said container inlet into engagement with said filling head such that said recess is closed by said rupturable closure; (e) means for injecting said sterilizing fluid into said recess; (f) means to rupture said rupturable closure; (g) means to actuate said valve to allow liquid to pass through said recess, and fill said container; and (h) heat sealing means located external to and below said fixed filling head.

3. A sterilizable product conduit comprising two openings allowing for ingress or egress of product, a valve member for opening and closing said conduit, structure defining a recess adjacent one of said openings, said recess structure adapted to abut a container seal located adjacent said recess structure while maintaining said seal area outside said recess structure, at least one sterilizing fluid inlet and at least one sterilizing fluid outlet onto said recess which are disposed at an oblique angle to product flow through said recess, and means mounted on said valve member for rupturing said container seal located adjacent said valve member, said valve member opening when said rupturing means are withdrawn from said container seal.

* * * * *